US011413499B2

(12) United States Patent
Maroldi

(10) Patent No.: US 11,413,499 B2
(45) Date of Patent: Aug. 16, 2022

(54) DEVICE TO PRODUCE ASSISTED, ACTIVE AND RESISTED MOTION OF A JOINT OR EXTREMITY

(71) Applicant: Nicholas Maroldi, New York, NY (US)

(72) Inventor: Nicholas Maroldi, New York, NY (US)

( * ) Notice: Subject to any disclaimer, the term of this patent is extended or adjusted under 35 U.S.C. 154(b) by 38 days.

(21) Appl. No.: 16/296,956

(22) Filed: Mar. 8, 2019

(65) Prior Publication Data

US 2019/0275368 A1 Sep. 12, 2019

Related U.S. Application Data

(60) Provisional application No. 62/640,777, filed on Mar. 9, 2018.

(51) Int. Cl.
*A63B 22/20* (2006.01)
*A63B 21/00* (2006.01)
(Continued)

(52) U.S. Cl.
CPC ..... *A63B 22/203* (2013.01); *A63B 21/00181* (2013.01); *A63B 21/0428* (2013.01);
(Continued)

(58) Field of Classification Search
CPC ..... A63B 21/4034; A63B 21/4035; A63B 21/00181; A63B 21/0428; A63B 21/04; A63B 21/159; A63B 21/4011; A63B 21/00185; A63B 2225/093; A63B 71/0036; A63B 2023/006; A63B 23/03508; A63B 23/0405; A63B 23/0494; A63B 22/04; A63B 22/203; A63B 2210/10; A63B 2210/00; A63B 2210/06; A63B 2071/1233; A63B 2071/1241; A63B 2071/125; A63B 2071/1258; A63B 2071/1266; A63B 2071/1275; A63B 2071/1283; A63B 2071/0072; A63B 2024/009; A63B 2024/0093; A63B 2024/0096; A63B 2031/112; A63B 69/00; A63B 69/0028;
(Continued)

(56) References Cited

U.S. PATENT DOCUMENTS 5,203,751 A * 4/1993 Chang ..... A63B 22/0002 482/70
5,280,783 A * 1/1994 Focht ..... A61H 1/0259 601/34

(Continued)

*Primary Examiner* — Megan Anderson
*Assistant Examiner* — Thao N Do
(74) *Attorney, Agent, or Firm* — Leason Ellis LLP

(57) ABSTRACT

A device for producing assisted motion, active motion, and resisted motion of the lower extremity. The device includes an upper leg support with two pull handles and a transverse axis of rotation for elevating and lowering the user's upper leg and a foot plate with a transverse axis of rotation and rollers on linear motion track(s) allowing the lower extremity to be secured into the device while maximizing range of motion of the knee joint. The upper leg support and the foot plate are both attached to the baseboard, but are not connected to each other and can move independently of each other, allowing the device to be used in multiple positions and to fit a wide range of lower extremity sizes without the need for the device to be adjusted or custom fit to the user's lower extremity.

19 Claims, 7 Drawing Sheets

(51) Int. Cl.
*A63B 21/055* (2006.01)
*A63B 71/00* (2006.01)
*A63B 21/04* (2006.01)

(52) U.S. Cl.
CPC ..... *A63B 21/0552* (2013.01); *A63B 21/159* (2013.01); *A63B 21/4011* (2015.10); *A63B 21/4034* (2015.10); *A63B 21/4035* (2015.10); *A63B 71/0036* (2013.01); *A63B 2225/093* (2013.01)

(58) Field of Classification Search
CPC ..... A63B 69/0062; A63B 69/0059; A63B 69/0035; A63B 69/0057; A61H 1/02; A61H 1/0218; A61H 1/0237; A61H 1/024; A61H 1/0244; A61H 2205/102–104
USPC ..... 482/13
See application file for complete search history.

(56) References Cited

U.S. PATENT DOCUMENTS 5,299,996 A * 4/1994 Chi ..... A63B 22/203 482/52
5,527,241 A * 6/1996 Peng ..... A61H 7/001 482/54
5,562,572 A * 10/1996 Carmein ..... A63B 22/02 198/779
5,954,619 A * 9/1999 Petrone ..... A63B 71/0036 482/106
5,993,358 A * 11/1999 Gureghian ..... A63B 22/02 482/54
6,030,324 A * 2/2000 McBride ..... A63B 21/4029 482/142
6,042,514 A * 3/2000 Abelbeck ..... A63B 22/02 482/54
6,053,848 A * 4/2000 Eschenbach ..... A63B 22/0207 482/54
6,123,647 A * 9/2000 Mitchell ..... A63B 22/02 198/456
6,152,854 A * 11/2000 Carmein ..... G06F 3/011 198/779
6,669,012 B1 * 12/2003 Yoshida ..... B65G 17/345 198/370.06
6,743,154 B2 * 6/2004 Epstein ..... G06F 3/011 482/54
7,125,367 B1 * 10/2006 Stearns ..... A63B 23/1245 482/141
7,628,733 B2 * 12/2009 Donner ..... A63B 22/0228 482/54
7,780,573 B1 * 8/2010 Carmein ..... A63B 71/0622 482/4
7,976,437 B1 * 7/2011 von Detten ..... A63B 22/0235 482/54
8,308,619 B1 * 11/2012 Astilean ..... A63B 21/156 482/54
8,343,016 B1 * 1/2013 Astilean ..... A63B 22/0046 482/54
8,696,606 B2 * 4/2014 Jacofsky ..... A61H 15/0078 601/122
10,493,317 B2 * 12/2019 Chen ..... A63B 22/02
10,632,339 B2 * 4/2020 Chen ..... A63B 21/0125
10,793,364 B1 * 10/2020 Skarlupka ..... B65G 39/12
2005/0006322 A1 * 1/2005 Kershaw ..... A63B 47/00 211/106
2005/0124473 A1 * 6/2005 Carlucci ..... A63B 21/055 482/142
2005/0273022 A1 * 12/2005 Diaz ..... A61H 1/024 601/5
2006/0183606 A1 * 8/2006 Parmater ..... A63B 22/0076 482/132
2007/0072743 A1 * 3/2007 Severino ..... A63B 22/0242 482/54
2007/0270285 A1 * 11/2007 Gill ..... A63B 22/02 482/54
2008/0029657 A1 * 2/2008 Evans ..... A63B 55/57 248/96
2009/0264226 A1 * 10/2009 Mauro ..... A63B 63/083 473/488
2011/0082015 A1 * 4/2011 Dreissigacker .. A63B 21/00069 482/72
2011/0253732 A1 * 10/2011 Tan ..... A63B 55/408 220/756
2012/0232438 A1 * 9/2012 Cataldi ..... A63B 21/4045 601/5
2012/0241570 A1 * 9/2012 Skipper ..... A63B 69/0048 248/220.21
2012/0253254 A1 * 10/2012 Rocklin ..... A61H 1/0222 602/32
2012/0302408 A1 * 11/2012 Burger ..... A63B 21/0087 482/54
2013/0043158 A1 * 2/2013 Flood, II ..... A63B 47/00 206/579
2013/0211297 A1 * 8/2013 Method ..... A61H 1/0237 601/34
2014/0005017 A1 * 1/2014 Smyth ..... A63B 23/0405 482/139
2014/0011642 A1 * 1/2014 Astilean ..... A63B 22/0285 482/54
2014/0088466 A1 * 3/2014 Hansen ..... A63B 21/4015 482/129
2014/0094721 A1 * 4/2014 Diallo ..... A63B 24/0087 601/5
2014/0148736 A1 * 5/2014 Hoffman ..... A61H 1/0259 601/5
2014/0243174 A1 * 8/2014 Alenaddaf ..... A63B 21/15 482/142
2016/0213972 A1 * 7/2016 Waldner ..... A63B 22/0058
2016/0367851 A1 * 12/2016 Astilean ..... B62M 6/40
2017/0100296 A1 * 4/2017 Method ..... A61H 1/0237
2018/0001173 A1 * 1/2018 Cupa ..... A63B 71/0622
2018/0008857 A1 * 1/2018 Barber ..... A63B 21/0428
2018/0036619 A1 * 2/2018 Kim ..... A63B 22/02
2018/0133544 A1 * 5/2018 Yoo ..... A63B 22/0285

* cited by examiner

DEVICE TO PRODUCE ASSISTED, ACTIVE AND RESISTED MOTION OF A JOINT OR EXTREMITY

CROSS-REFERENCE TO RELATED PATENT APPLICATIONS

This application is based on and claims priority to U.S. Provisional Patent Application 62/640,777, filed Mar. 9, 2018, the entire contents of which is incorporated by reference herein as if expressly set forth in its respective entirety herein.

TECHNICAL FIELD

This invention pertains to a device intended to produce assisted, active, and resisted motion of a joint or extremity. The device is intended to be used in physical and functional rehabilitation of a patient's joint or extremity, specifically intended to be used for bending, stretching, and/or strengthening a patient's lower extremity.

BACKGROUND

Physical and functional treatment of extremities frequently involves mobilizing, bending, and stretching of joints. Currently, this treatment is provided manually by physical therapists or by Continuous Passive Motion machines, frequently referred to by the abbreviation "CPM."

The CPM machine is a motorized device that passively flexes and extends the effected joint. Research on the effectiveness of the CPM machine has shown that long term range of motion following total knee arthroplasty surgery is no different between patients who used the CPM machine and patients who did not. Furthermore, use of a CPM machine is associated with a longer length of stay and higher patient and hospital and/or rehabilitation center cost. CPM machines are also heavy and are a common cause of employee injury leading to further costs for the hospital and/or rehabilitation center.

Despite the lack of effectiveness and increased cost associate with the CPM machine, many surgeons and patients request the use of a CPM machine to ensure that the effected joint is exposed to increasing range of motion. In many cases, patients request additional physical therapy visits for range of motion, because they cannot perform range of motion on their own secondary to pain, weakness, inflammation, and/or decreased sensation.

The purpose of the invention is to eliminate the above mentioned disadvantages by providing a lightweight, easy-to-use device to improve a patient's knee joint range of motion and lower extremity function, without the assistance of a physical therapist or the bulk and expense of the CPM machine. In addition, the device can be used throughout the rehabilitation process as resistance bands can be added and altered to progress or regress the resistance or assistance to the intended movement.

SUMMARY

According to this invention, the device designed to provide assisted, active, and resisted motion for mobilizing, bending, stretching, and strengthening the lower extremity, is characterized by the fact that it consists of a upper leg support that moves about a transverse axis to allow elevating and lowering of the upper leg and a footplate for securing the foot and ankle into the device and moving along longitudinal tracks. Modifications to assistance or resistance to the intended movement can be made by altering the resistance bands that can attach to the sides of the foot plate and to either end of the longitudinal tracks.

BRIEF DESCRIPTION OF THE DRAWING FIGURES

Other advantages of this invention will be explained in the detailed description of the attached drawings, where:

Figure 4:
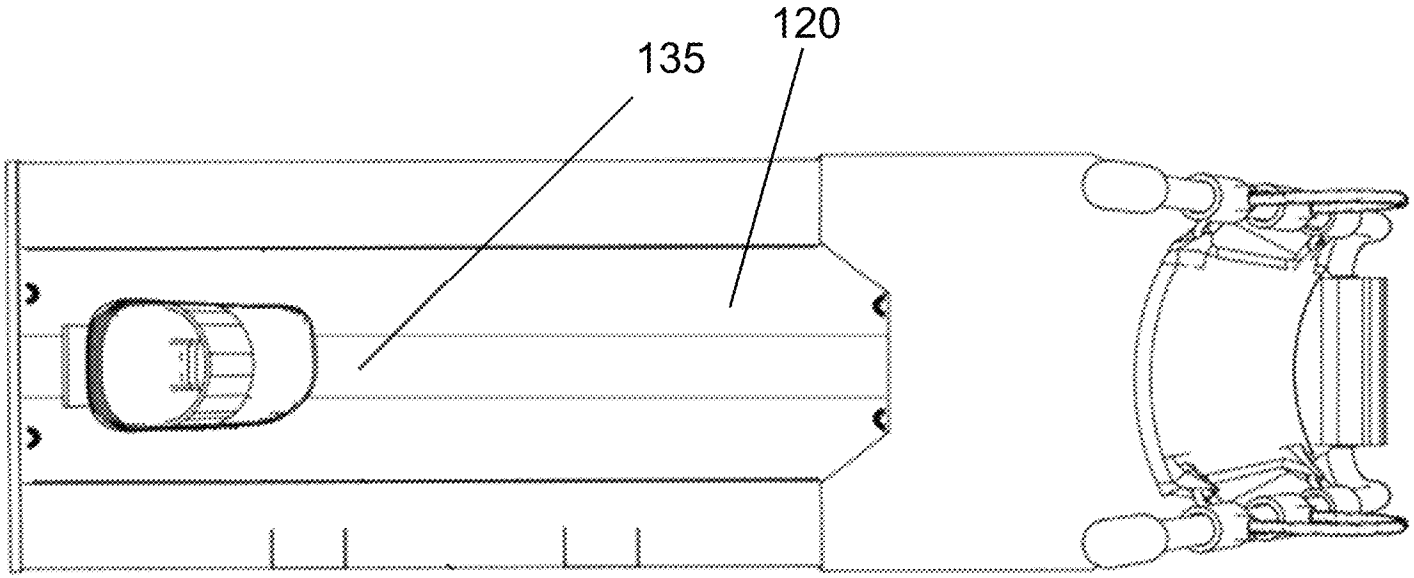
Figure 5:
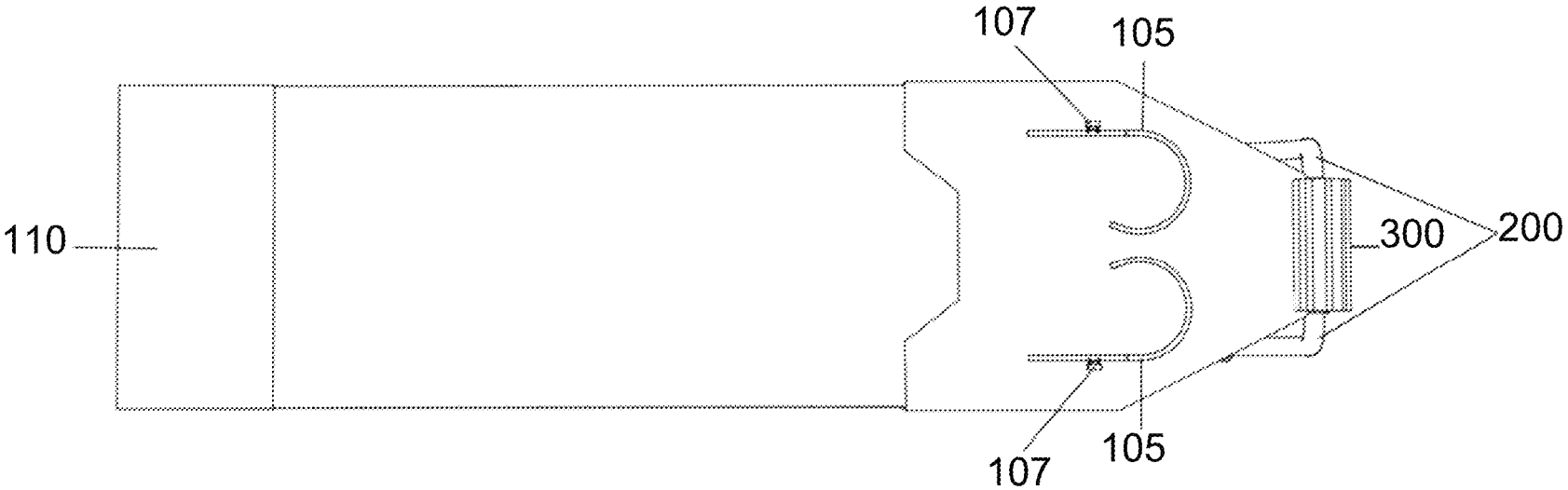
Figure 6:
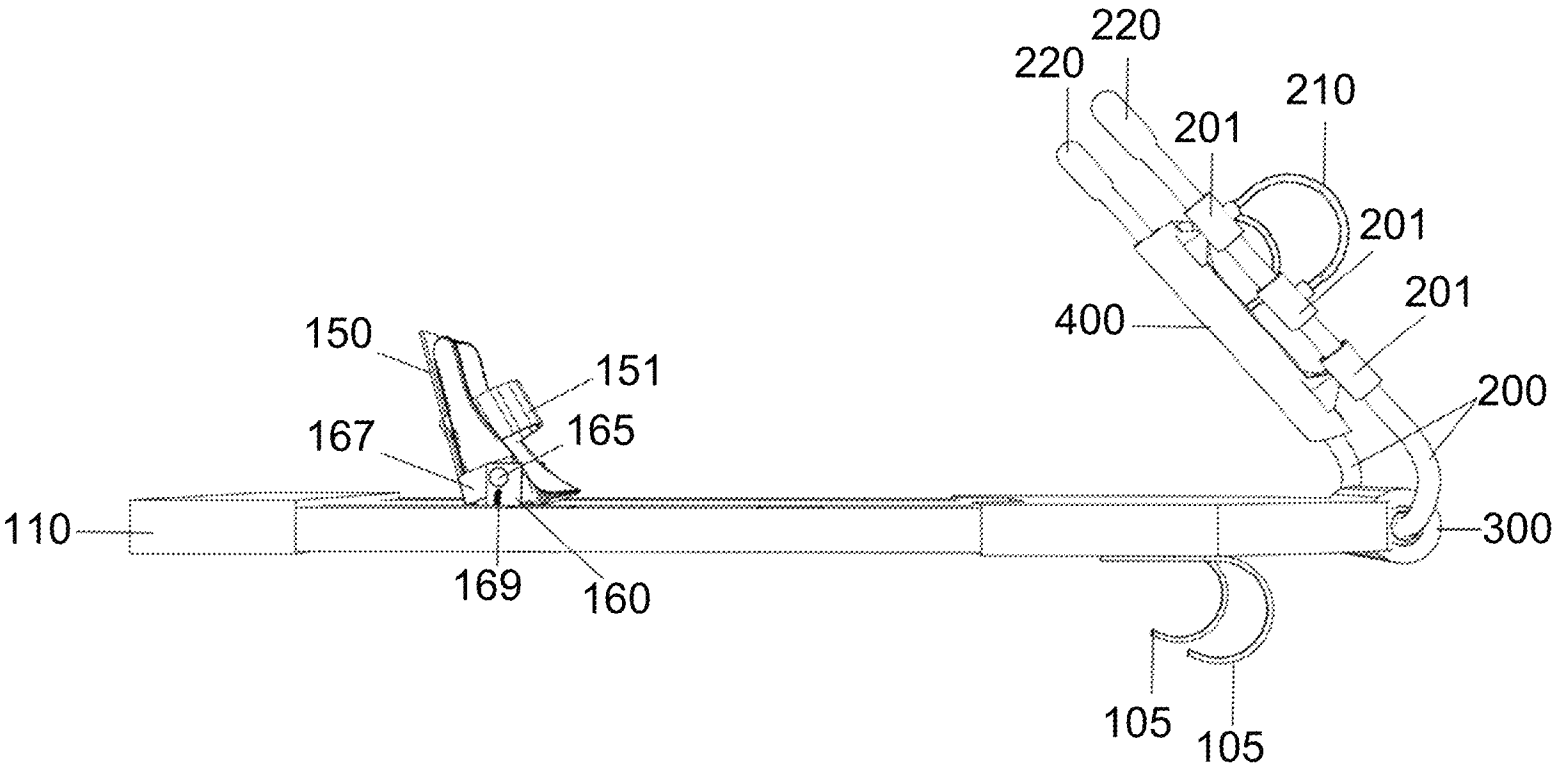
Figure 7:
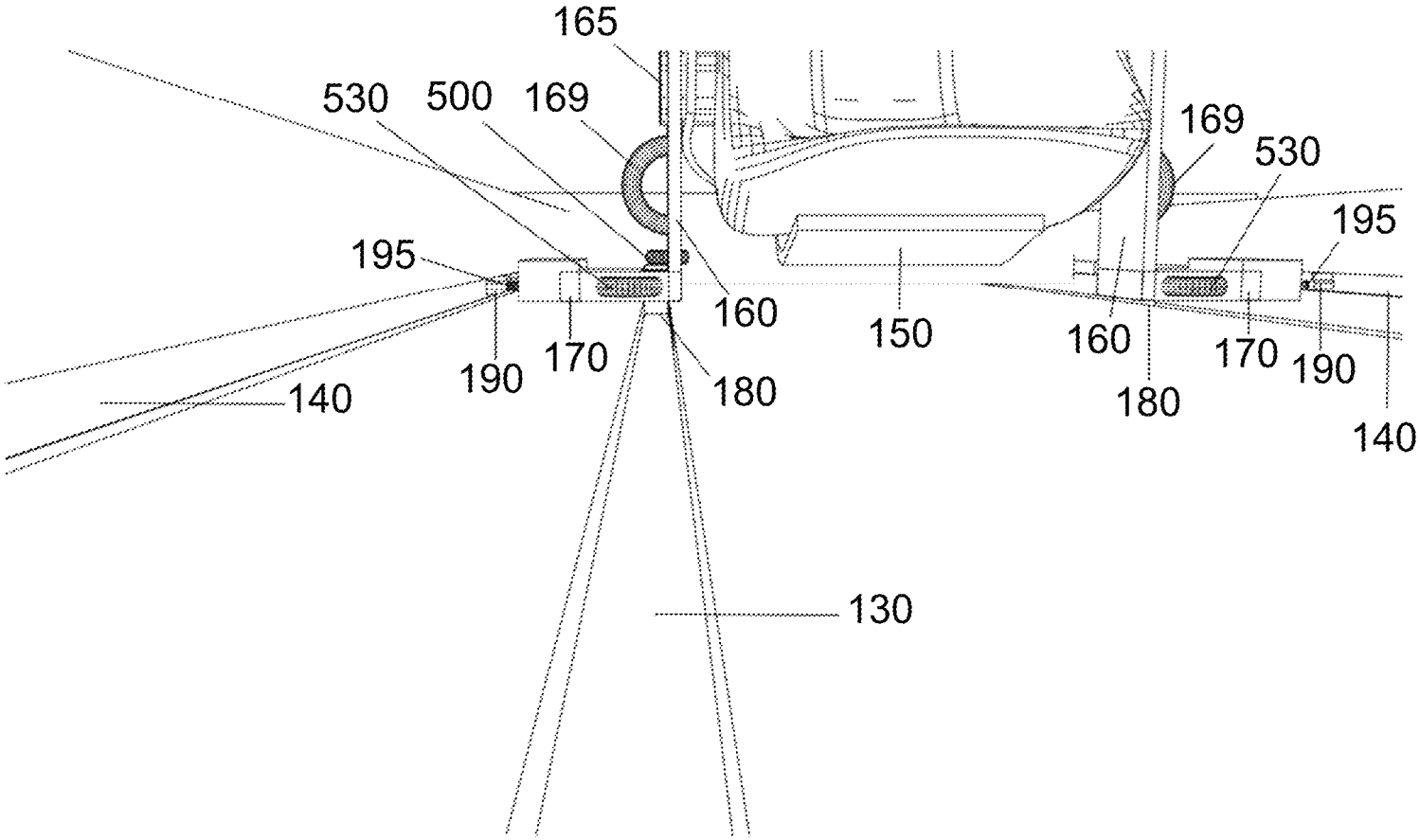

FIG. 4 is a superior view of the device illustrating the orientation of the footplate and rollers to the linear motion tracks, as well as the orientation of the resistance band attachment points, demonstrating a single central linear motion track FIG. 5 is an inferior view of the device illustrating the storage hooks folded under the baseboard for when the device is not hung by the hooks and when the device is in use;

FIG. 6 is a lateral view of the device illustrating the device with the hooks open for securing the device to a bedrail or any other structure for storage and easy user access; and FIG. 7 is a perspective view of the footplate and its attached rollers secured into the linear motion tracks on the baseboard.

DETAILED DESCRIPTION OF CERTAIN EMBODIMENTS

Now referring to FIGS. 1-7, a device 100 is disclosed and is configured to produce an assisted, active, and resisted motion of a joint or extremity. The device 100 can be used interchangeably for the left or right lower extremity. As described herein, the device 100 is configured to be used by a user (patient) in a wide number of settings and includes features that permit ease of storage as in a patient room, etc.

The device 100 is meant to be placed on a support surface, such as a floor, and is formed of a number of parts that are coupled so as to form an assembly as described herein. More particularly, the device 100 has a base portion that lies along the support surface and an upright portion that protrudes upwardly therefrom and is configured to support the upper section of the extremity. The base portion of the device 100 can consist of a base 110 that has a first (distal) end 112 and an opposing second (proximal) end 114. As illustrated, the first end 112 can be formed of 90 degree side walls, while the proximal portion of the base 110 can have an inward taper that terminates at the second end 114.

The base 110 has a recessed portion 120 formed along a length thereof and in particular, the recessed portion 120 is formed such that there is a distal portion of the base 110 that is located distal to the recessed portion 120 and is free of any recess and similarly, there is a proximal portion that is proximal to the recessed portion 120 and is free of any recess. The recessed portion 120 thus extends longitudinally. The recessed portion 120 is thus formed of a floor 122 and a pair of opposing side walls 124 that are formed at a 90 degree angle relative to the floor 122.

The device 100 has a number of tracks or guide (guide rails) that are associated with the base 110 and located within the recessed portion 120. For example, there can be a pair of first tracks 130 that are disposed along the floor 122 and a pair of second tracks 140 that are formed along the opposing side walls 124. While the drawings depict the first tracks 130 as being a different structure relative to the floor 122, it will be appreciated that the first tracks 130 can instead constitute sections of the floor 122 and not be formed of an element that is separate and different from the floor 122 itself. In the illustrated embodiment, the first tracks 130 are spaced apart from one another and are parallel to one another. The first tracks 130 can be linear in shape and can be slightly raised planar surfaces relative to the floor.

Each of the second tracks 140 can comprise a linear channel (groove) that is formed in one of the side walls 124. The two second tracks 140 are thus oriented parallel to one another.

The lengths of the first tracks 130 and second tracks 140 can be the same such that they begin and end at the same points within the recessed portion 110 or alternatively, they could have different lengths.

As described herein, the first tracks 130 and second tracks 140 are configured and arranged to allow travel of a movable (sliding) part of the device 100 and more specifically, the device 100 includes a footplate 150 that is coupled to an rides along the first tracks 130 and second tracks 140. The footplate 150 is configured to receive a foot of the user and provides a surface on which the foot is placed and the fact that the footplate 150 can move linearly (slide) along the first tracks 130 and the second tracks 140 allows for flexion and extension of the knee. In other words, the footplate 150 is coupled to the base 110 via the first tracks 130 and second tracks 140 to allow forward and backward travel of the footplate 150 based on user movement.

As described herein, the footplate 150 travels along the tracks 130, 140 using conventional mechanism, including but not limited to the use of rollers that are coupled to the footplate 150 and the rollers can be in the form of wheels, ball bearings, treads, etc.

The footplate 150 thus rides within the recessed portion 110.

In one embodiment, the footplate 150 is coupled to and contact both the first tracks 130 and the second tracks 140. For example, the footplate 150 can consist of a flat support surface with a curved heel support and the bottom portion of the footplate 150 and includes a foot support strap 151 that is configured to secure the user's foot onto the footplate 150. The foot support strap 151 extends across the footplate 150 and can be adjusted (loosened and tightened) to achieve a secure holding of the foot. A fastener, such as a buckle or hook and loop material, can be used to secure the strap 151 in place.

The footplate 150 can be coupled to a pair of first coupling members 160 (footbed upright supports) that provide the means for movingly coupling the footplate 150 to the first tracks 130 and the second tracks 140. The first coupling members 160 can be in the form of a pair of parallel upright plates connected to side walls of the footplate 150. At a bottom end of each of the first coupling members 160, there is a lateral roller support 170 that extends radially outward from the first coupling member 160. The lateral roller support 170 can be formed at a 90 degree relative to the respective first coupling member 160 (thus, the lateral roller support 170 and the first coupling member 160 can define an L-shaped structure with the length of the lateral roller support 170 being less than the length of the first coupling member 160). When the footplate 150 is inserted into the recessed portion, the two lateral roller supports 170 extend outwardly in different directions towards the side walls 124 of the recessed portion 120. The underside of the lateral roller support 170 faces the floor 122.

As described below, the pair of first coupling members 160 can be attached to the footplate 150 by means of a pair of footplate attachments 167 (FIG. 6) that are located along opposing sides of the footplate 150.

As previously mentioned, the footplate 150 includes means for rollingly traveling within the recessed portion 120 along the first and second tracks 130, 140. For example, the footplate 150 can have a first set of rollers 180 that contact and ride along the first tracks 130 defined along the floor 122 and a second set of rollers 190 that contact and ride along the second tracks 140. More specifically, the first set of rollers 180 comprises a pair of rollers that are rotatingly coupled to one of the first coupling member 160 and the lateral roller support 170. For example, the roller 180 can be considered to be a medial roller that is rotatingly coupled to the lateral roller support and positioned against one of the first tracks 130. Each second roller 190 is configured to be received within the channel that defines the second track 140 and rides therein. As a result, the second roller 190 can be located at an outer end of the lateral roller support 170. The second roller 190 can thus be coupled to an axle that passes transversely across the footplate 150 and the recessed portion 120. The second rollers 190 are thus located above the first rollers 180. In this way, the second rollers 190 are at least partially contained within the linear channels 140 defining the second tracks and the first rollers 180 seat and ride along the first tracks 130.

The second rollers 190 rotate about a roller axis 195 that extends through the coupling members 160.

In order to initially insert and engage the second rollers 190 into the channels 140, the side walls 124 in which the channels 140 are formed can have a pair of slots open along the top edge of the side walls 124 and being in communication with the channels 140. Thus, the user can initially insert the second rollers 190 into these opening and drop the second rollers 190 downward until they are axially aligned with the channels 140 into which they can enter and then travel linearly therein. At the same time when the second rollers 190 are in this position, the first rollers 180 seat on the first tracks 130. The locking of the second rollers 190 into the channels 140 provides support and stability for the footplate 150 and ensures it does not freely disengage from the base 110.

Figure 2:
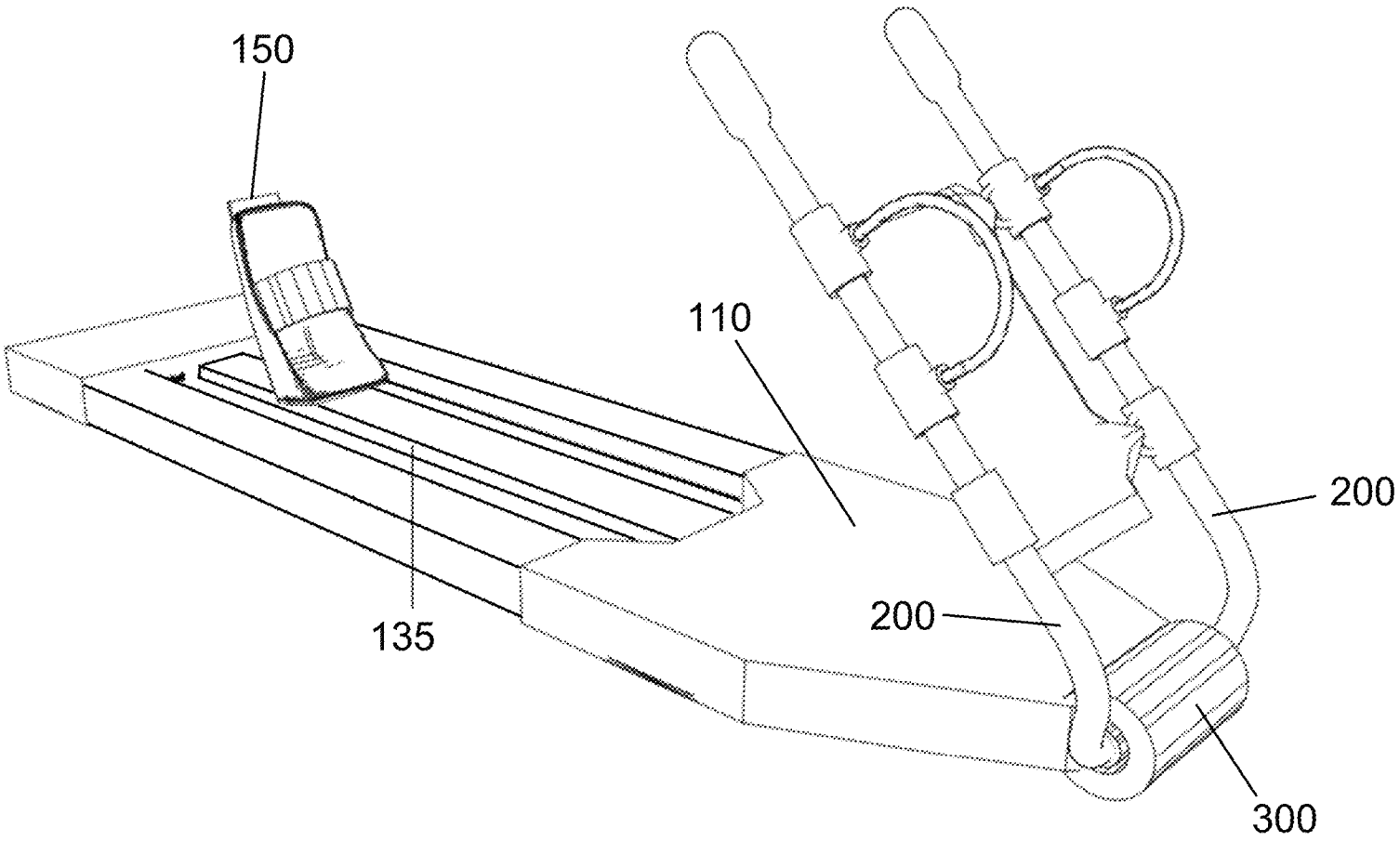
FIG. 2 is a perspective view of a device for producing assisted, active, and resisted motion of the lower extremity, demonstrating a single central linear motion track according to another embodiment.

FIGS. 2 and 4 show an alternative embodiment in which the first and second tracks 130, 140 are eliminated and instead, a single track 135 is disposed along the floor 122. The footplate 150 includes one or more bottom rollers that ride along the single track 135 within the recessed portion 120 of the base 110.

The device 100 also includes a front support structure intended for the upper section of the extremity and configured to assist in bending and extending the knee. As illustrated, the device 100 includes a pair of upper leg supports 200 that are located at the second (proximal) end of the base 110. As described herein, the upper leg supports 200 can each be formed of multiple parts that are attached to one another to form the elongated structure. Each of the upper leg supports 200 pivot relative to the base 110 to allow the upper leg support to be pivoted relative to the base 110 to change the angle therebetween. This pivoting action of the upper leg supports 200 is used as part of the knee exercising program that is described in more detail herein.

For example, the bottom portion of each upper leg support 200 can be pivotally attached to the base 110. The two upper leg supports 200 preferably move in unison; however, they can more separately. However, in any event and according to one aspect of the present invention, the movement of the upper leg supports 200 is independent from the movement of the footplate 150.

Figure 1:
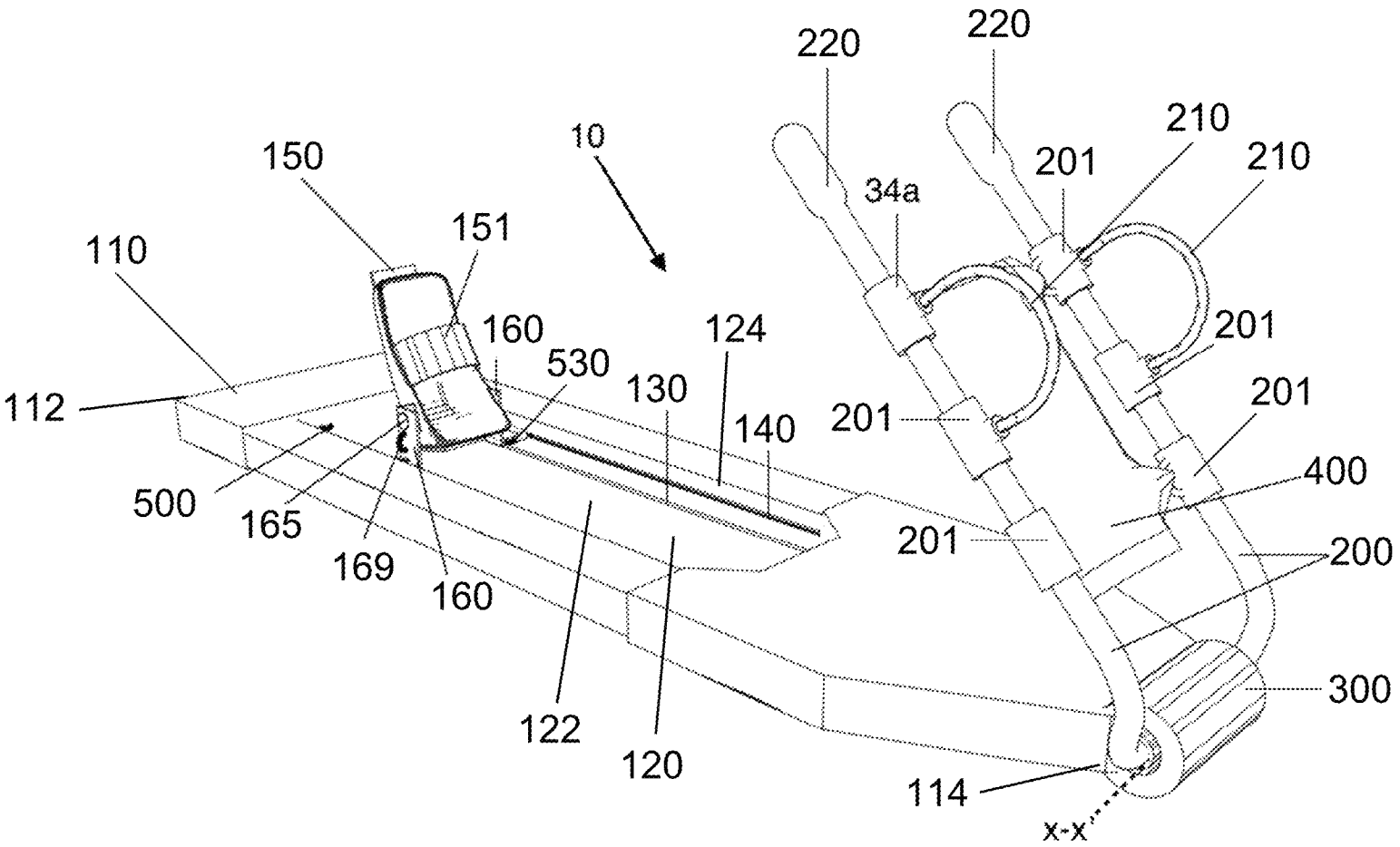
FIG. 1 is a perspective view of a device for producing assisted, active, and resisted motion of the lower extremity according to one embodiment.

The upper leg supports 200 move between a down position in which the upper leg supports 200 are located proximate the base 110 and an up position in which the upper leg supports 200 are positioned at an angle relative to the base 110 (see FIG. 1). The pivoting upper leg supports 200 are used to raise and lower the upper leg during the treatment (exercise regime) as described herein. It will also be appreciated that, as described herein, the upper leg supports 200 can be eliminated and instead, the user can directly grasp the footplate 150 via pull handles that can be optionally installed directly on the footplate 150. In this way, the linear motion of the footplate 150 is translated into bending/extension of the knee.

The upper leg support 200 are elongated structures that can have different cross-sectional shapes, including tubular as shown. A lock mechanism, as known in the art, can be provided to ensure that the upper leg support 200 remains in a locked desired position (e.g., locked in the lowered position).

In addition, each of the upper leg supports 200 can have a telescoping feature in that the length of the upper leg support 200 can be increased or decreased. Tightening sleeves, as known in the art, can be used to maintain the upper leg support 200 in its desired, selected length.

The upper leg supports 200 can be pivotally attached directly to the base 110 and can be separate structures with each connected to the base 110. Alternatively, the upper leg supports 200 can be part of an integral U-shaped structure with a bottom cross (transverse) bar connecting the two elongated upright leg supports that are parallel to one another. Between the two elongated upper leg supports 200 is a tubular structure 300 that is located at the proximal end of the base 110. The bottom cross bar that connects the two elongated upper leg supports 200 passes through the bore of the tubular structure 300. The tubular structure 300 can be a cylindrical shape with a center bore and can have a ribbed or contoured outer surface for providing increased grip.

Along each of the upper leg supports 200 a pull handle 210 can be provided. The illustrated pull handle 210 has a curved shape (e.g., D-shaped or semi-circular shaped); however, any number of handle shapes and sizes are equally possible. The pull handles 210 can be detached from the upper leg supports 200 to allow telescoping adjustment of the upper leg supports 200 or they can be coupled to first segments of the upper leg supports 200. The pull handles 210 are configured for being grasped by the user's hands and they face outward away from the base 110 and the footplate 150. Optional grips 220 can also be provided and can be installed at the upper free ends of the upper leg supports 200. The grips 220 can be in the form of rubber end caps that are attached to the upper ends of the upper leg supports 200.

An upper leg support sling 400 can be disposed between the upper leg supports 200. The upper leg support sling 400 can be formed of any number of different materials, such as a fabric, and is attached along its sides (ends) to the upper leg supports 200. The sling 400 is preferably made of soft material to hammock the upper leg for user comfort. The upper leg support sling 400 can be attached to the supports 200 by use of fasteners. As illustrated, each of the upper leg supports 200 can include enlarged tubular portions (connectors) 201 and the proximal most tubular portion 201 and the distal most tubular portion 201 can include a coupling element, such as a D-shaped connector, to which the sling 400 can be attached. Much like a hammock, it extends between the upper leg supports 200 with a degree of give to allow movement and flexing of the sling 400.

As shown, the pull handles 210 can also be connected to the tubular portions 201 that are formed along the upper leg supports 200.

Figure 3:
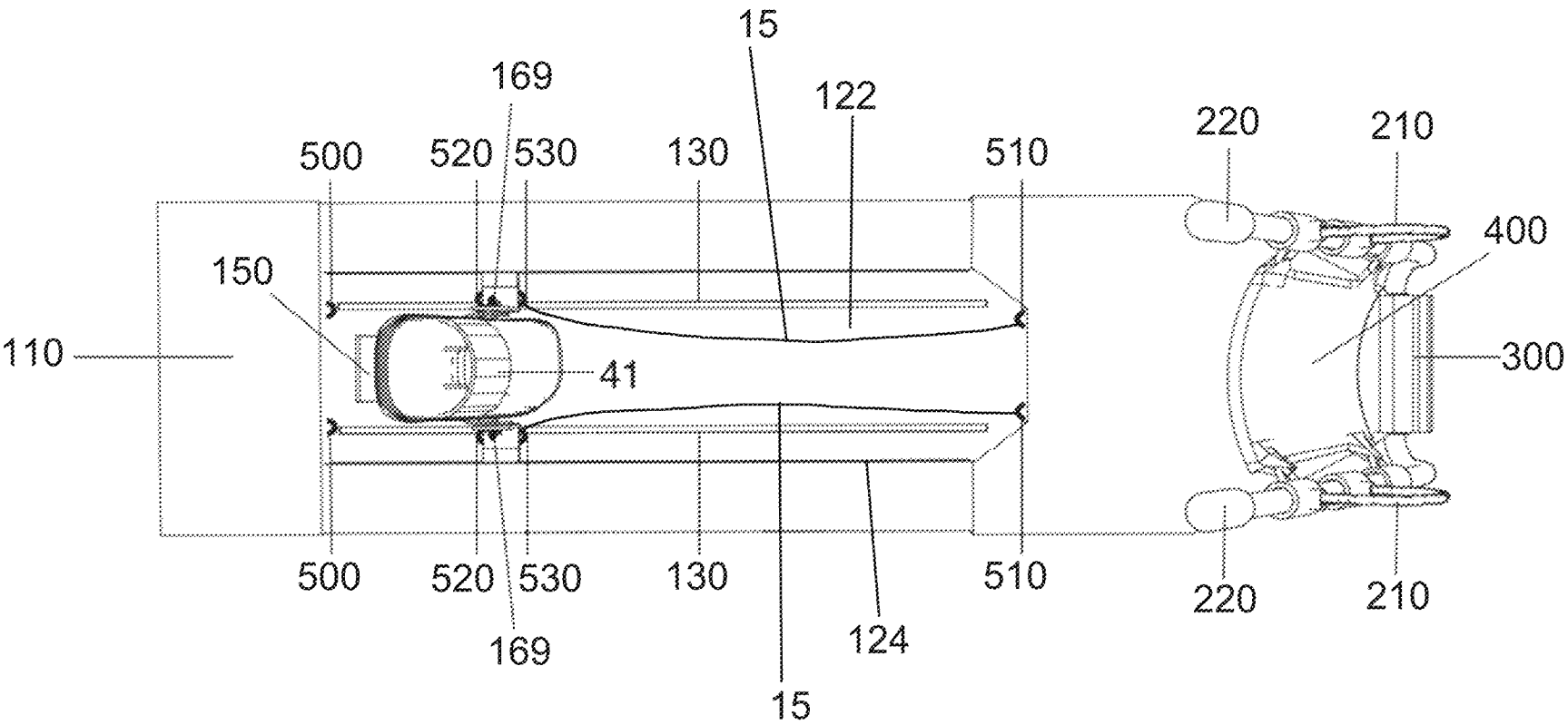
FIG. 3 is a superior view of the device illustrating the orientation of the footplate and rollers to the linear motion tracks, as well as the orientation of the resistance band attachment points.

The device 100 also has a number of features that allow for the rolling resistance of the footboard 150 to be altered by the user. In other words, the user can make the footboard 150 more difficult to roll along the tracks 130, 140 or can make it easier to roll along the tracks 130, 140. In one embodiment, the mechanism for altering the rolling resistance comprises at least one and preferably, a plurality of resistance bands 15 (FIG. 3). The base 110 includes at least one and preferably a set of connectors and more specifically, includes a pair of first connectors 500 that represent distal connectors and are located at or near the distal first end 112 of the base 110 and more particularly, the first connectors 500 are located at or near the distal end of the recessed portion 120. A pair of second connectors 510 that represent proximal connectors are located at or near the proximal second end 114 of the base 110 and more particularly, the second connectors 510 are located at or near the proximal end of the recessed portion 120. The pair of first connectors 500 are spaced apart from one another and the pair of second connectors 510 are spaced apart from one another. The first and second connectors 500, 510 can come in any number of different forms including half-ring shaped connectors and can have a C-shape or D-shape to allow for attachment of a resistance band 15 thereto.

The first and second connectors 500, 510 serve as attachment points for resistance bands 15 to enable modification to the roller resistance (of the sliding footplate 150) to allow for changes in resistance or assistance to movement of the lower extremity.

Each lateral roller support 170 can have a third connector 520 at a distal side (end) thereof and a fourth connector 530 at the proximal side (end) thereof. The third and fourth connectors 520, 530 can be the same or similar to the first and second connectors 500, 510 and thus, can be in the form of half-ring shaped connectors (e.g., C-shaped or D-shaped). The third and fourth connectors 520, 530 allow for attachment of the resistance bands 15 that can connect to first and second connectors 500, 510. The attachment of the resistance bands 15 allows the option for assisted or resisted knee flexion and assisted or resisted knee extension. This can be utilized in multiple ways, including providing low load long duration stretching into knee extension, which is critical during early recovery following total knee replacement arthroplasty. Thus, when resistance bands are used, one end of the band can be attached to one of the first connector 500 and the second connector 510 and the other end can be attached to one of the third connector 520 and the third connector 530, thereby modifying the roller resistance of the footplate 150.

Example

A pair of resistance bands 15 can be used in the following manner. For example, one resistance band can be attached to the connector 52*a* to the connector 56*a* and another band can be attached to the connector 52*b* to the connector 56*b*. This arrangement of resistance bands causes the footplate 150 to be pulled away from the user and thus, assists in knee extension and resists bending of the knee. Alternatively, one resistance band can be attached to the connector 58*a* to the connector 54*a* and another band can be attached to the connector 58*b* to the connector 54*b*. This arrangement of resistance bands causes the footplate 150 to be pulled toward the user and thus, assists in knee bending and resists in knee extension.

While FIG. 3 shows a pair of resistance bands 15 being used, it will be appreciated that a single resistance band can be used instead of using a pair of resistance bands and in particular, the same functionality of the resistance bands 15 can be achieved with one resistance band 15 going from the footplate 150 proximally and/or one resistance band 150 going from the footplate 150 distally, rather than pairs of bands 15 as illustrated.

In yet another aspect of the present invention, the underside of the base 110 can have a means for hanging the device 100 and in particular, can have one or more and preferably a pair of hooks 105 or the like. The hooks 105 have curved ends that allow the hooks 105 and the device 100 to be hung (suspended). In yet another aspect, the hooks 105 can be pivotally attached to the underside of the base 110. For example, each hook 105 can be hingedly connected to the underside of the base 110 with a hinge element 107 so as to permit the hooks 105 to fold out so that the device 100 can be hung on a bedrail or any other structure for easy user access in a hospital or rehabilitation setting or in a home setting and the hooks 105 can fold back into the base 110 for a flat undersurface during device 100 use.

As described herein, the proximal end 114 of the base 110 attaches to the upper leg supports 200. This attachment can be in the form of the tubular structure 300 (hollow tube) for the upper leg supports to pass through providing a transverse axis of rotation x-x' for elevating and lowering the upper leg. Another options is attachment of two separate support bars (bottom portions of the upper leg supports 200) by fasteners to a transverse axis of rotation that allows the separate support bars to pivot about the axis of rotation in unison.

The upper leg support 200 thus can consist of a support bar(s) (bottom portions of the supports 200) attached to the baseboard as described above that runs parallel to the upper leg on both sides. The support bar(s) can be made adjustable by use of distal component and a hollow proximal component to allow for adjustability via telescoping of the distal component within the proximal component. The telescoping bars are adjustable and securable by fasteners on the support bars.

If using a multi-track system, pivots 165 can connect the footplate attachments 167 to the respective first coupling members 160 to allow motion of the footplate 150 about a transverse axis, allowing for user's ankle motion during motion of the footplate along the track(s) 130, 140. The lateral sides of the first coupling members 160 have attachment points 169 for optional attachment of additional pull handles to allow the user to assist lower extremity motion from the footplate 150, in addition to or rather than the upper leg supports 200. For example, the attachment points 169 can be in the form of half-ring attachment elements. In other words, the invention can be modified to allow the user to assist the lower extremity movement by pulling on pull handles, such as pull handles 210, that are attachable to the footplate 150. This option is available by attaching additional pull ropes to the attachment points 169 on the lateral sides of the first coupling members 160. Another modification regarding the utility of the design is the ability of the user to perform assisted, active, or resisted motion of the knee in a seated position by securing the user's foot into the footplate 150 without the use of the upper leg support. This option illustrates one benefit of the independent motion of the footplate 150 and the upper leg support 200. Another benefit is the wide range of user sizes that can fit the design secondary to the lack of a knee joint axis so the device does not need to be custom fit or adjusted to fit the user.

Example

The device 100 is intended to be used as follows. The user positions the upper leg supports 30 in the lowered positions relative to the base 110 and positions his or her foot onto the footplate 150 with the upper leg of the user being positioned in the sling 400. The user then raises the upper leg supports 200 which causes the sling 400 to be raised relative to the base 110 and at the same time this action is translated into movement of the footplate 150 and in particular, raising of the supports 200 causes the footplate 150 to slide toward the user. This likewise results in bending of the knee. Once the knee is bent, the user then lowers the upper leg by lowering the upper leg supports 200 and sling 400 and this is translated into the footplate 150 sliding in a direction away from the user. This action causes knee extension and the leg is lowered. The user then continuous repeats these steps resulting in movement (extension/flexion) in the knee joint.

In the event that the upper leg supports 200 are eliminated and pull handles are connected to the attachments 169 of the footplate 150, the user causes extension and flexion in the knee by attaching a cord (resistance band) to each of the attachments 169 and then the user pulls the footplate 150 toward the user to cause knee flexion and then user slowly releases the footplate 150 in a direction away from the user to cause knee extension.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A device for producing assisted motion, active motion, and resisted motion of a lower extremity of a user comprising:

a base having a distal end, a proximal end, and at least one longitudinal track defined thereon, said base terminating at the distal end and the proximal end;

a footplate configured to receive a foot of the user, the footplate slidingly traveling along the at least one longitudinal track; and an upper limb support defined by a pair of spaced apart elongated upper leg supports with a sling extending therebetween for receiving an upper portion of a leg of a user while the foot of the user is received on the footplate, the pair of spaced apart elongated upper leg supports being pivotally attached to the base at the proximal end;

wherein pivoting movement of the upper limb support and sliding movement of the footplate are independent from one another;

wherein the base includes a recessed portion in which the at least one longitudinal track is disposed and the footplate slidingly travels;

wherein the at least one longitudinal track comprises at least one first longitudinal track formed along a floor of the recessed portion and at least one channel formed along a side wall of the recessed portion that extends upwardly from the floor, the footplate including at least one first roller for traveling along the at least one first longitudinal track and at least one second roller for traveling within the at least one channel.

2. The device of claim 1, wherein the base includes a pair of first connectors disposed at or near a distal end of the recessed portion and a pair of second connectors disposed at or near a proximal end of the recessed portion, the pairs of first connectors and the second connectors being configured for securing at least one pair of resistance bands to the footplate.

3. The device of claim 2, wherein the footplate includes a pair of third connectors and a pair of fourth connectors, with one of the pair of third connectors and one of the pair of fourth connectors being located along one side of the footplate, the other one of the pair of third connectors and other one of the pair of fourth connectors being located along an other side of the footplate, the pair of third connectors and the pair of fourth connectors being configured for securing the at least one pair of resistance bands.

4. The device of claim 1, wherein the pair of spaced apart elongated upper leg supports of the upper limb support move between a lowered position in which the pair of spaced apart elongated upper leg supports are positioned proximate an upper surface of the base and a raised position in which the pair of spaced apart elongated upper leg supports are formed at an acute angle relative to the base.

5. The device of claim 4, wherein each of the pair of spaced apart elongated upper leg supports includes a pull handle.

6. The device of claim 1, wherein the footplate includes a flat support surface with a curved heel support and a foot retaining strap.

7. The device of claim 1, wherein the at least one first roller rotates about a first axis and the at least one second roller rotates about a second axis, the first axis and the second axis being parallel to one another, the second axis being spaced a greater distance from the floor of the recessed portion compared to the first axis.

8. The device of claim 1, wherein the at least one longitudinal track comprises a single longitudinal track formed along a floor of the recessed portion, the footplate including a single roller for traveling along the single longitudinal track.

9. The device of claim 1, wherein the footplate moves in a longitudinal direction relative to the base, while the pair of spaced apart elongated upper leg supports pivot relative to the base independently from a longitudinal movement of the footplate.

10. The device of claim 1, wherein the pair of spaced apart elongated upper leg supports comprise telescoping poles.

11. A device for producing assisted motion, active motion, and resisted motion of a lower extremity of a user comprising:

a base having a distal end, a proximal end, and at least one longitudinal track defined thereon, said base terminating at the distal end and the proximal end;

a footplate configured to receive a foot of the user, the footplate slidingly traveling along the at least one longitudinal track; and an upper limb support defined by a pair of spaced apart elongated upper leg supports with a sling extending therebetween for receiving an upper portion of a leg of a user while the foot of the user is received on the footplate, the pair of spaced apart elongated upper leg supports being pivotally attached to the base at the proximal end;

wherein pivoting movement of the upper limb support and sliding movement of the footplate are independent from one another;

wherein an underside of the base includes a pair of hooks configured for hanging the base on a support surface, each of the pair of hooks being hingedly connected to an underside and movable between a stowed position and an extended position.

12. The device of claim 1, wherein the footplate includes a pair of roller supports comprising a pair of upright supports that are pivotally coupled to attachment members provided along sides of the footplate and a pair of lateral supports connected to the pair of upright supports and oriented normal thereto, each of the pair of roller supports includes a first roller that rides along one first track and a second roller that rides along one second track, the first rollers disposed along a first axis that is located below a second axis along which the second rollers are disposed, the second rollers located radially outward from the first rollers.

13. The device of claim 1, wherein the base has a proximal portion containing an inward taper, and the inward taper terminates at the proximal end.

14. The device of claim 1, wherein the pair of spaced apart elongated upper leg supports are attached at the proximal end in such a manner that a movement in a longitudinal direction of the base is restricted.

15. The device of claim 1, wherein the pair of spaced apart elongated upper leg supports are connected through a tubular structure located at the proximal end of the base.

16. A device for producing assisted motion, active motion, and resisted motion of a lower extremity of a user comprising:

a base having a distal end, a proximal end, and at least one longitudinal track defined thereon, said base terminating at the distal end and the proximal end;

a footplate configured to receive a foot of the user, the footplate slidingly traveling along the at least one longitudinal track; and an upper limb support defined by a pair of spaced apart elongated upper leg supports with a sling extending therebetween for receiving an upper portion of a leg of a user while the foot of the user is received on the footplate, the pair of spaced apart elongated upper leg supports being pivotally attached to the base at the proximal end;

wherein pivoting movement of the upper limb support and sliding movement of the footplate are independent from one another;

wherein the base includes a recessed portion in which the at least one longitudinal track is disposed and the footplate slidingly travels;

wherein the base includes a pair of first connectors disposed at or near a distal end of the recessed portion and a pair of second connectors disposed at or near a proximal end of the recessed portion, the pairs of first connectors and the second connectors being configured for securing at least one pair of resistance bands to the footplate;

wherein the footplate includes a pair of third connectors and a pair of fourth connectors, with one of the pair of third connectors and one of the pair of fourth connectors being located along one side of the footplate, the other one of the pair of third connectors and other one of the pair of fourth connectors being located along an other side of the footplate, the third connectors and the fourth connectors being configured for securing the at least one pair of resistance bands;

wherein the at least one longitudinal track comprises a pair of first tracks and a pair of second tracks, the footplate includes a pair of roller supports comprising a pair of upright supports that are coupled to sides of the footplate and a pair of lateral supports connected to the pair of upright supports and oriented normal thereto, each of the pair of roller supports includes a first roller that rides along one of the pair of first tracks and a second roller that rides along one of the pair of second tracks.

17. The device of claim 16, wherein the pair of first tracks are formed along a floor of a recessed portion formed in the base and the pair of second tracks comprise channels formed in side walls of the recessed portion, the footplate slidingly traveling within the recessed portion.

18. The device of claim 17, wherein the first rollers are formed along a first axis and the second rollers are formed along a second axis that is parallel to the first axis but spaced above the first axis.

19. A device for producing assisted motion, active motion, and resisted motion of a lower extremity of a user comprising:

a base having a distal end, a proximal end, and at least one longitudinal track defined thereon, said base terminating at the distal end and the proximal end;

a footplate configured to receive a foot of the user, the footplate slidingly traveling along the at least one longitudinal track; and an upper limb support defined by a pair of spaced apart elongated upper leg supports with a sling extending therebetween for receiving an upper portion of a leg of a user while foot of the user is received on the footplate, the pair of spaced apart elongated upper leg supports being pivotally attached to the base at the proximal end;

wherein pivoting movement of the upper limb support and sliding movement of the footplate are independent from one another;

wherein the at least one longitudinal track comprises a pair of first tracks and a pair of second tracks, and the pair of first tracks extends parallel to the pair of second tracks in a longitudinal direction of the base.

* * * * *